US005833500A

United States Patent [19]

Mahon et al.

[11] Patent Number: 5,833,500

[45] Date of Patent: Nov. 10, 1998

[54] TERMINAL FIXTURE AND A METHOD OF MANUFACTURING THE SAME

[75] Inventors: Tony Mahon, County Galway, Ireland; Masakuni Samejima, Shizuoka-ken, Japan

[73] Assignee: Yazaki Corporation, Tokyo, Japan

[21] Appl. No.: 623,521

[22] Filed: Mar. 29, 1996

[30] Foreign Application Priority Data

Mar. 30, 1995 [JP] Japan ..... 7-073852

[51] Int. Cl.[6] ..... H01R 11/22

[52] U.S. Cl. ..... 439/852; 439/857; 29/874

[58] Field of Search ..... 439/850, 851, 439/852, 856, 857, 842, 843, 845, 849, 867; 29/874, 879

[56] References Cited

U.S. PATENT DOCUMENTS

| | | | |
|---|---|---|---|
| 3,760,340 | 9/1973 | Friend | 439/847 |
| 4,798,545 | 1/1989 | Roy et al. | 439/856 |

FOREIGN PATENT DOCUMENTS

| | | | |
|---|---|---|---|
| 000632533A2 | 1/1995 | European Pat. Off. | 439/852 |
| 51-51490 | 4/1976 | Japan . | |
| 52-22593 | 2/1977 | Japan . | |
| 59-79982 | 5/1984 | Japan . | |
| 4-315778 | 11/1992 | Japan . | |
| 2 220 310 | 1/1990 | United Kingdom . | |

*Primary Examiner*—Neil Abrams
*Assistant Examiner*—Tho Dac Ta
*Attorney, Agent, or Firm*—Finnegan, Henderson, Farabow, Garrett & Dunner, L.L.P.

[57] ABSTRACT

A terminal fixture of the present invention comprises an electric wire connection member connected to the terminal of an electric wire; a pair of elastic contact members in which the respective top ends of a pair of side plates opposite to each other and bent in the same direction from a bottom plate are bent inward in a reverse U-shape; and a protective plate member comprising a front protective plate provided integrally with the above-mentioned bottom plate on the front side of the pair of elastic contact members, a pair of side protective plates which surround the outside of the above-mentioned pair of side plates and is formed by bending both the sides of the front protective plate on the above-mentioned electric wire connection member side, and a top plate which is located between the above-mentioned electric wire connection member and the above-mentioned pair of elastic contact members and top end thereof is extendedly provided from the one side protective plate and locked to the other side protective plate.

10 Claims, 4 Drawing Sheets

TERMINAL FIXTURE AND A METHOD OF MANUFACTURING THE SAME

BACKGROUND OF THE INVENTION

1. Industrial Field of Utilization

The present invention relates to a terminal fixture having an electric wire connection member connected to an electric wire terminal and an elastic connection member connected to a mating terminal, and to a method of manufacturing the terminal fixture.

2. Prior Art

A terminal fixture of prior art comprises an electric wire connection member tightened and connected to the terminal of an electric wire and an elastic contact member connected to a mating terminal. The electric wire connection member comprises an insulation tightening part which is provided at the rear end thereof and in which the electric wire is tightened together with an insulator, and a conductor tightening part in which a conductor of the electric wire is tightened. In the elastic contact member, a pair of side plates are raised in the same direction from both the sides of the bottom thereof, and the top ends of the side plates are bent inward in a reverse U-shape to form a pair of contact parts.

Also, inserted between the pair of contact parts is a mating terminal (which, in this case, is a plate-shaped male terminal) to connect electrically. Further, formed between the elastic contact member and the conductor tightening part are support walls for supporting the top end of the mating terminal inserted between the pair of contact parts, and formed between the top ends of the support walls is a slit.

Then, the mating terminal is inserted between the slit and the pair of contact parts, whereby the mating terminal is held by a moderate elastic force between the pair of contact parts to connect electrically.

However, in the above-mentioned terminal fixture, the elastic contact member is exposed, so that an external force may be applied to the member when being handled or transferred, thereby causing the member to be deformed or broken. The elastic contact member, if deformed or broken, will not be able to get a normal connection with the mating terminal.

Thus, in the terminal fixture described in Japanese Laid-Open Patent No. SHO 59-79982, U.S. Pat. No. 3760340 and Japanese Laid-Open Patent No. HEI 4-315778, the elastic contact member thereof is surrounded with a protective part, so that even if an external force is applied inadvertently to the elastic contact member, the member will not be deformed or broken, thereby allowing it to be protected.

However, in the terminal fixture disclosed in the above-mentioned official gazettes, there has been a problem in that a separated protective part is mounted around the elastic contact member, so that a special mold is required to mold the protective part, and a process of mounting the protective part is also required, thereby causing the cost of manufacturing the terminal fixture to become expensive.

Thus, the official gazette of Japanese Laid-Open Utility Model No. SHO 52-22593, British Patent No. GB2220310A, and the official gazette of Japanese Laid-Open Utility Model No. SHO 51-51490 propose a terminal fixture which is integrally molded in a manner to be molded while the protective part thereof is punched. In the terminal fixture described in the above-mentioned official gazette of Japanese Laid-Open Utility Model No. SHO 52-22593, when the terminal fixture is molded, respective walls composing the protective part are bent in a manner to surround the elastic contact part.

In the terminal fixture described in the official gazette, the elastic contact member is surrounded with the protective part, so that no external force is applied inadvertently to the member, which is thus not deformed or broken.

However, if an external force is applied to the respective walls composing the protective part, the walls will be dislocated from each other to cause the entire shape of the terminal fixture to be deformed. If the entire shape of the terminal fixture is deformed, the terminal fixture, when inserted into, for example, a terminal housing and the like, will not be inserted smoothly, or even when being able to be inserted, it may not be locked securely to the inside of the terminal housing.

SUMMARY OF THE INVENTION

Thus, an object of the present invention is to provide a terminal fixture in which elastic contact members thereof are securely protected and a method of manufacturing the terminal fixture.

In order to achieve the above-mentioned purpose, the present invention provides a terminal fixture, comprising an electric wire connection member connected to the terminal of an electric wire; a pair of elastic contact members in which the respective top ends of a pair of side plates opposite to each other and bent in the same direction from a bottom plate are bent inward in a reverse U-shape; and a protective plate member comprising a front protective plate provided integrally with the above-mentioned bottom plate on the front side of the pair of elastic contact members, a pair of side protective plates which surround the outside of the above-mentioned pair of side plates and is formed by bending both the sides of the front protective plate on the above-mentioned electric wire connection member side, and a top plate which is located between the above-mentioned electric wire connection member and the above-mentioned pair of elastic contact members and top thereof end thereof is extendedly provided from the one side protective plate and locked to the other side protective plate.

According to this invention, the front end side of the elastic contact members is protected by the front protective plate, and the side plate side thereof is protected by the side protective plates. In this case, even when a force in a direction in which it urges inward the pair of side plates is applied to the elastic contact members, the top plate has been extendedly provided from the one side protective plate and locked to the other side protective plate, so that the elastic contact members have a high rigidity against the force in that direction, and the entire shape of the protective plates is not deformed. Also, a force from the upper side of the elastic contact members is received by the top plate to protect the elastic contact members. Also, in this case, the top plate has been extendedly provided from the one side protective plate and locked to the other side protective plate, so that the elastic contact members have a high rigidity against the force in a direction in which it is applied from the upper side to the top plate, and the entire shape of the protective plates is hardly deformed. Accordingly, the terminal fixture of the present invention is hardly deformed, whereby the elastic contact members are securely protected.

In a preferred embodiment of the present invention, provided between the above-mentioned electric wire connection member and the above-mentioned pair of elastic contact members are a pair of support walls which are bent in the same direction from the above-mentioned bottom plate and urge the under surface of the above-mentioned top plate to support.

According to this form, even when a force from the upper side is applied to the top plate, the top plate is supported by the pair of support walls, so that the top plate has a strong rigidity and is hardly deformed against the force in that direction.

In a preferred embodiment of the present invention, a cutout is provided at the top end of the above-mentioned top plate; a prong inserted into the cutout is provided on the above-mentioned other side protective plate; and catch parts overlapping the outside of the above-mentioned other side protective plate are bent and formed at the top end of the above-mentioned top plate.

According to this form, even when a force of deforming inward the side protective plate is applied, the prong of the other side protective plate is inserted into the cutout provided at the top end of the top plate, whereby the side protective plate has a strong rigidity and is hardly deformed inward. Also, even when a force of deforming outward the side protective plate is applied, the catch parts have been formed in a manner to overlap the outside of the other side protective plate, so that the side protective plate is strong against the force in that direction and hardly deformed.

Also, the present invention provides a terminal fixture, comprising an electric wire connection member connected to the terminal of an electric wire; a pair of elastic contact members in which the respective top ends of a pair of side plates opposite to each other and bent in the same direction from a bottom plate are bent inward in a reverse U-shape; side protective plates which are bent from the front side of the above-mentioned bottom plate and formed perpendicularly to the above-mentioned pair of side plates; a pair of front protective plates which are bent and formed from the respective front side of the above-mentioned pair of side plates to surround the front side of the above-mentioned side protective plates; a pair of rear protective plates which are bent and formed in a direction in which they approach each other from the above-mentioned electric wire connection member of the above-mentioned pair of side plates; and top plates which are located between the above-mentioned electric wire connection member and the above-mentioned pair of elastic contact members and extendedly provided from both sides of the above-mentioned pair of side plates so as to be overlapped each other and linked.

According to this invention, when a force in a direction in which it urges inward the one side plate is applied, the side protective plate prevents the one side plate from being deformed. Also, the front side of the elastic contact members is protected by the front protective plates, while the rear side thereof is protected by the rear protective plates. In this case, even when a force in a direction in which it urges inward the pair of side plates is applied, the top plates have been overlapped each other and linked, so that the pair of side plates are high in rigidity against the force in that direction and hardly deformed. Also, a force from the upper side of the elastic contact members is received by the top plates to protect the elastic contact members. Further, a force in a direction in which it compresses the elastic contact members is received by the rear protective plates whose top end abuts the elastic contact members, so that the elastic contact members are high in rigidity against the force in that direction and not deformed in the compressed direction. Accordingly, the terminal fixture of the present invention is hardly deformed, whereby the elastic contact members are securely protected.

In a preferred embodiment of the present invention, the above-mentioned top plates comprise a lower side plate which is extendedly provided from the one side plate and bent to the other side plate side, and an upper side plate which is extendedly provided from the other side plate and bent to the one side plate side so as to be overlapped on the lower side plate, whereby the lower side plate and the upper side plate are linked through a link part.

According to this form, a force from the upper side of the elastic contact members is received by the top plates whose lower side plate and upper side plate are overlapped on each other, so that the terminal fixture is high in rigidity against the force in that direction and the entire shape thereof is not deformed.

In a preferred embodiment of the present invention, the above-mentioned link part comprises a lock hole provided on the above-mentioned one side plate side of the above-mentioned lower side plate, and a catch part which is provided at the top end of the above-mentioned upper side plate so as to be inserted into the above-mentioned lock hole and engaged with the open edge of the above-mentioned lock hole.

According to this form, when a force in a direction in which both the side plates are separated is applied, the catch part of the upper side plate has been engaged with the open edge of the lock hole of the lower side plate, thereby preventing both the side plates from being separated.

Also, on the contrary, when a compressive force is applied to both the side plates, the lower side plate abuts the inner wall on the one side plate side of the upper side plate, thereby preventing both the side plates from being deformed.

Also, the present invention provides a method of manufacturing a terminal fixture, comprising the steps of punching a flat plate in a spread state to integrally form a bottom plate, an electric wire connection member connected to the terminal of an electric wire, a pair of side plates, a pair of elastic contact members connected to a mating terminal, and a protective plate member comprising a front protective plate provided on the front side of the pair of elastic contact members, a pair of side protective plates surrounding the outside of the above-mentioned pair of side plates, and a top plate which is located between the above-mentioned electric wire connection member and the above-mentioned pair of elastic contact members and provided on the upper side of the above-mentioned pair of elastic contact members; bending in the same direction parts which are located on the both the sides of the above-mentioned bottom plate and correspond to the above-mentioned electric wire connection member to form the member; bending a pair of top ends of parts which are extendedly provided on both the sides of the above-mentioned bottom plate and correspond to the above-mentioned pair of side plates in the same direction and in a U-shape, and then bending the parts corresponding to the above-mentioned pair of side plates in the same direction to form the above-mentioned pair of side plates and the above-mentioned elastic contact members; bending parts corresponding to the above-mentioned pair of side protective plates in the same direction with respect to parts corresponding to the above-mentioned front protective plate, and bending parts corresponding to the above-mentioned front protective plate toward the above-mentioned elastic contact members to form the above-mentioned front protective plate and the above-mentioned pair of side protective plates; and bending a part corresponding to the above-mentioned top plate extendedly provided from the one side protective plate toward the other side protective plate, and locking the top end of the part to the above-mentioned other side protective plate to form the above-mentioned top plate.

According to this invention, the protective plate member is formed integrally in the flat plate-shape and spread state on the front side of the bottom plate; the side protective plates on both the sides of the front protective plates are bent in the same direction as that of the side plates; the front protective plates are bent to the elastic contact member side to overlap the outside of the side plate; and then the top plate of the one side protective plate is bent toward the other side protective plate, and the top end of the top plate is locked to the other side protective plate, so that the protective plate member for protecting the elastic contact members can be manufactured together with the molding of the terminal fixture, whereby the manufacturing cost is held low and the elastic contact members are securely protected by the protective plate member.

Also, the present invention provides a method of manufacturing a terminal fixture, comprising the steps of punching a flat plate in a spread state to integrally form a bottom plate, an electric wire connection member connected to the terminal of an electric wire, a pair of side plates, a pair of elastic contact members connected to a mating terminal, a pair of side protective plates and a pair of front protective plates provided on the front side of the pair of elastic contact members, a rear protective plate provided on the above-mentioned electric wire connection member side of the pair of elastic contact members, and a top plate which is located between the above-mentioned electric wire connection member and the above-mentioned pair of elastic contact members and provided on the upper side of the above-mentioned pair of elastic contact members and which comprises an upper side plate, a lower side plate and a link part for linking both the plates; bending in the same direction parts which are located on the both the sides of the above-mentioned bottom plate and correspond to the above-mentioned electric wire connection member to form the member; bending both the front side and the above-mentioned electric wire connection member side of parts which are extendedly provided on both the sides of the above-mentioned bottom plate and correspond to the above-mentioned pair of side plates in the same direction to form the above-mentioned pair of front protective plates and the above-mentioned pair of rear protective plates; bending a pair of top ends of parts corresponding to the above-mentioned pair of side plates in the same direction and in a U-shape to form the above-mentioned elastic contact members; bending the other respective top ends of parts corresponding to the above-mentioned pair of side plates in the same direction to form the above-mentioned upper side plate and the above-mentioned lower side plate; bending parts extendedly provided on the front side of the above-mentioned bottom plate to form the above-mentioned pair of side protective plates; and bending respective parts corresponding to the above-mentioned pair of side plates in the same direction to form the above-mentioned pair of side plates and at the same time, linking the above-mentioned link part in a state in that the above-mentioned upper side plate is overlapped on the above-mentioned lower side plate to form the above-mentioned top plate.

In a preferred embodiment of the present invention, the above-mentioned top plate comprises a lock hole provided on the above-mentioned one side plate side of the above-mentioned lower side plate and a catch part provided at the top end of the above-mentioned upper side plate; and the catch part is inserted into the above-mentioned lock hole and engaged with the open edge of the above-mentioned lock hole to form the above-mentioned top plate.

The nature, principle and utility of the invention will become more apparent from the following detailed description when read in conjunction with the accompanying drawings.

DESCRIPTION OF THE PREFERRED EMBODIMENTS

With reference to the drawings, the embodiments of the present invention will be explained hereinafter.

First Embodiment

Figure 1A:
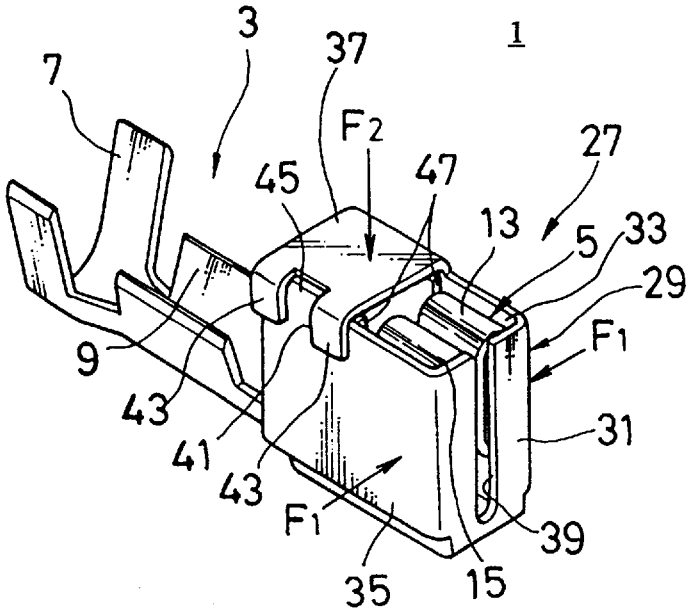
FIG. 1A is a perspective view of a first embodiment of a terminal fixture according to the present invention.
Figure 1B:
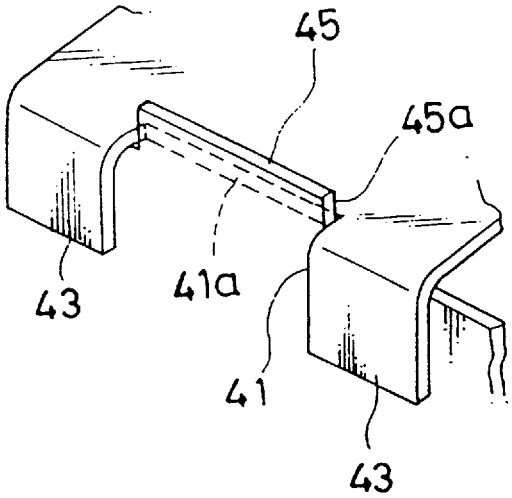
FIG. 1B is a partially enlarged perspective view of the terminal fixture shown in FIG. 1A.
Figure 2A:
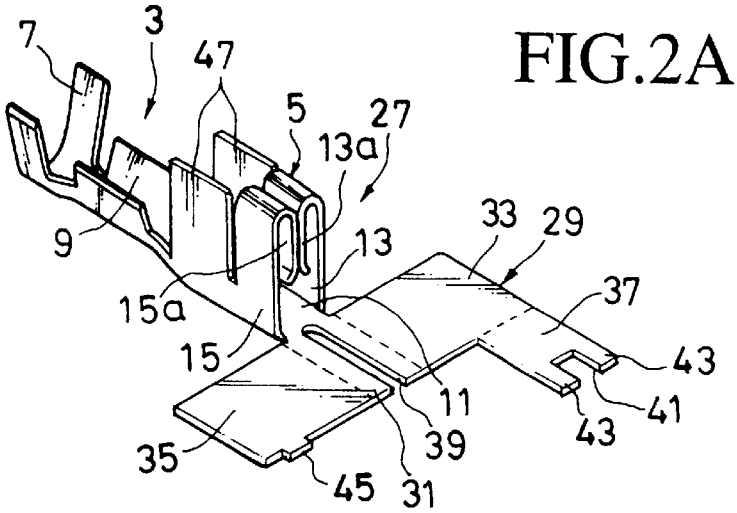
FIG. 2A shows a method of manufacturing the terminal fixture of the first embodiment according to the present invention, and is perspective view showing, in particular, a protective plate member in a spread state.
Figure 2B:
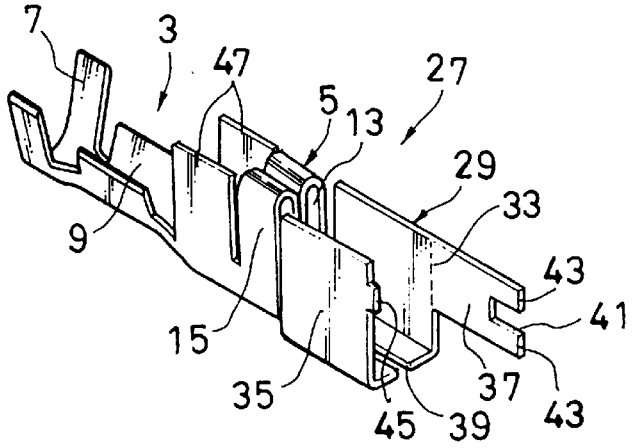
FIG. 2B shows a method of manufacturing the terminal fixture of the first embodiment according to the present invention, and is perspective view showing, in particular, a side protective plate in a bent state.
Figure 2C:
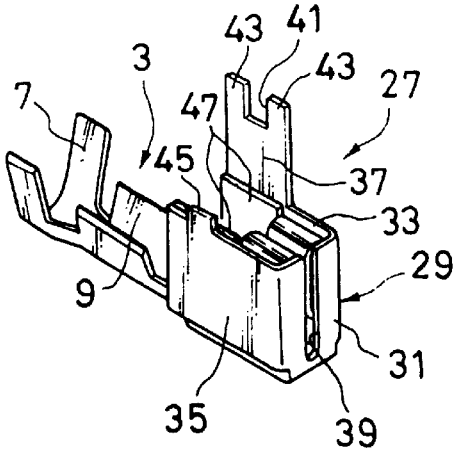
FIG. 2C shows a method of manufacturing the terminal fixture of the first embodiment according to the present invention, and is perspective view showing, in particular, a front protective plate in a bent state.

FIGS. 1A and 1B are perspective views of the first embodiment of a terminal fixture according to the present invention; and FIGS. 2A, 2B and 2C show a method of manufacturing the terminal fixture of the first embodiment according to the present invention.

In these figures, a terminal fixture 1 comprises an electric wire connection member 3 tightened and connected to the terminal of an electric wire, an elastic contact member 5 connected to a mating terminal, and a protective plate member 29 for protecting the elastic contact member 5. The electric wire connection member 3 comprises an insulation tightening part 7 which is provided at the rear end thereof and in which the electric wire is tightened together with an insulator, and a conductor tightening part 9 in which a conductor of the electric wire is tightened. In the elastic contact member 5, a pair of side plates 13, 15 are raised in the same direction from both the sides of a bottom 11 thereof, and the top ends of the side plates 13, 15 are bent inward in a reverse U-shape to form a pair of contact parts 13*a*, 15*a*.

Also, inserted between the pair of contact parts 13*a*, 15*a* is a mating terminal (which, in this case, is a plate-shaped male terminal) to connect electrically.

Then, the mating terminal is inserted between the pair of contact parts 13*a*, 15*a*, whereby the mating terminal is held by a moderate elastic force between the pair of contact parts 13*a*, 15*a* to connect electrically.

The protective plate member 29 comprises a front protective part 31 which is formed by being bent in the same direction as that of the pair of side plates 13, 15 from the front side of the bottom 11 and which covers the front side of the elastic contact member 5, a pair of side protective plates 33, 35 which are formed by bending both the sides of the front protective part 31 toward the elastic contact member 5 side to surround the outside of the side plates 13, 15, and a top plate 37 which is located between the electric wire connection member 3 and the elastic contact member 5 and which is extendedly provided from the one side protective plate 33 and whose top end is locked to the other side protective plates 35.

The front protective part 31 is formed by extending the bottom plate 11 as shown in FIG. 2A, the length of which is set at a value somewhat larger than the height of the elastic contact member 5. Also, formed in the front protective part 31 is a slit 39 which extends from the bottom plate 11 side and corresponds to a position at which the top ends of the pair of contact parts 13*a*, 15*a* contact each other. Both the sides of the front protective part 31 are extended along the pair of side plates 13, 15, whereby the pair of side protective plates 33, 35 are formed, respectively.

The pair of side protective plates 33, 35 are formed such that their height is equal to the height of the front protective part 31, and their length is longer than the elastic contact member 5. Formed between the elastic contact member 5 and the conductor tightening part 9 is the top plate 37 by being bent from the top end of the one side protective plate 33.

Formed at the top end of the top plate 37 is a rectangular cutout 41. Both the sides of the cutout 41 are bent downward to form a pair of catch parts 43, 43. These catch parts 43, 43 are caught by the outside of the top end of the other side protective part 35.

Protrusively provided at the top end of the other side protective part 35 is a prong 45. The prong 45 is formed such that its width dimension is equal to the frontage dimension of the above-mentioned cutout 41, and its height dimension is larger than the thickness dimension of the top plate 37. The prong 45 is press fitted in the cutout 41, whereby the inner surface of 45*a* the prong 45 abuts a bottom wall 41*a* of the cutout 41. In this state, the other side protective part 35 is firmly linked between the pair of catch parts 43, 43 caught by the outside of the other side protective part 35 and the bottom wall 41*a*. This causes the pair of side protective parts 33, 35 to become high in rigidity against a force F1 (see FIG. 1A) in a direction in which the front protective parts are pushed inward, whereby the top plate 37 and the side protective part 35 are not dislocated from each other.

Also, as shown in FIG. 2A, formed between the conductor tightening part 9 and the elastic contact member 5 are a pair of support walls 47, 47 by being bent from both the sides of the bottom plate 11. The height of the pair of support walls 47, 47 is substantially equal to that of the pair of side protective parts 33, 35, and the top ends thereof abut the under surface of the top plate 37 to support.

A method of manufacturing a terminal fixture will be explained hereinafter.

As shown in FIG. 2A, the front protective plate 31, the pair of side protective plates 33, 35 and the top plate 37 are molded in a spread state by being punched from a flat plate. Then, the side protective plates 33, 35 on both the sides of the front protective plate 31 are bent substantially perpendicularly and in the same direction as that of the pair of side plates 13, 15, as shown in FIG. 2B.

Then, as shown in FIG. 2C, the front protective plate 31 is bent substantially perpendicularly from the front side of the bottom plate 11 toward the elastic contact member 5 side. In this state, the pair of side protective plates 33, 35 are arranged in a manner to overlap the pair of side plates 13, 15, whereby the elastic contact member 5 is surrounded by the pair of side protective plates 33, 35 and the front protective plate 31.

Further, the top plate 37 formed integrally with the one side protective plate 33 is bent toward the other side protective plate 35 side; the prong 45 is press fitted in the cutout 41; and the pair of catch parts 43, 43 are caught by the top end of the other side protective plate 35. In this state, the top ends of the pair of support walls 47, 47 abut the under surface of the top plate 37, whereby the top plate 37 is supported by the pair of support walls 47, 47.

According to this embodiment, the front protective plate 31, the pair of side protective plates 33, 35 and the top plate 37 composing the protective plate member 29 are not dislocated from each other, so that the entire shape is hardly deformed. That is, with respect to a force F1 of deforming inward the pair of side protective plates 33, 35, the protective plate member 29 of this embodiment become strong in rigidity in that direction and is hardly deformed by press fitting of the prong 45 of the other side protective plate 35 in the cutout 41 of the top plate 37 bent from the one side protective plate 33 to cause the inner side of the prong 45 to abut the bottom wall 41*a* of the cutout 41. Also, with respect to a force (opposite to F1) in a direction in which the pair of side protective plates 33, 35 are deformed inward, the pair of catch parts 43, 43 are caught by the outside of the other side protective plate 35, so that the protective plate member 29 is strong in rigidity in that direction and hardly deformed.

Also, even when a force F2 from the upper side is applied to the top plate 37, the catch parts 43 of the top plate 37 are caught by the top end of the other side protective plate 35, and at the same time, the top ends of the support walls 47, 47 abut the under surface of the top plate 37, so that the protective plate member 29 is strong in rigidity in that direction and hardly deformed against the force in that direction. Accordingly, the terminal fixture of the present invention is hardly deformed, thereby allowing the elastic contact member to be securely protected, a normal connection with a mating terminal to be performed, and a reliability in electrical connection to be improved.

Further, the protective plate member 29 of this embodiment requires no special mold to form the protective plate member 29 due to a step of extending the bottom plate 11 to form the protective plate member 29 integral with the terminal fixture 27. Also, by extending of the step of molding the elastic contact member 5 and the electric wire connection member 3, the protective plate member 29 can be molded, so that a step of mounting the protective plate member 29 to the terminal fixture also becomes unnecessary, thereby allowing the manufacturing cost to be reduced.

Second Embodiment

Figure 3A:
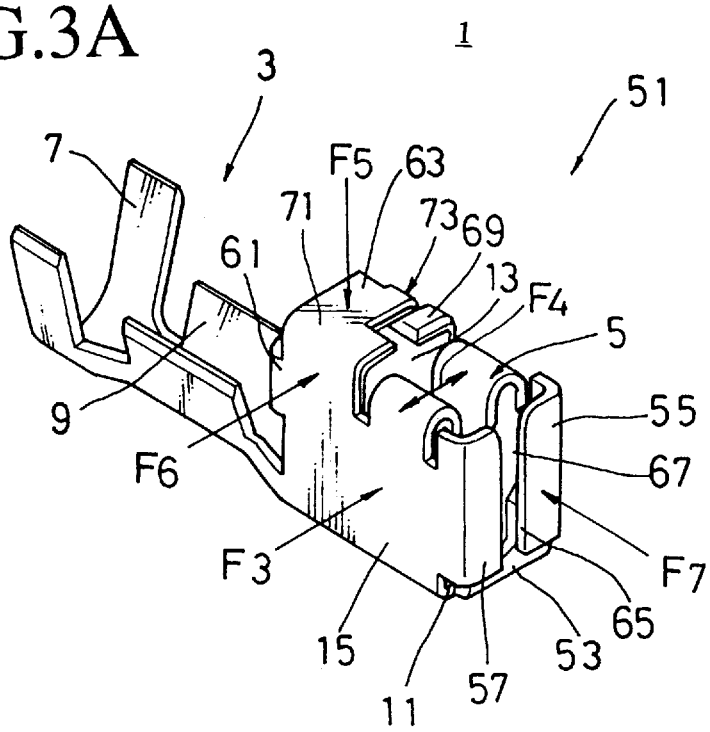
FIGS. 3A and 3B are perspective views of a second embodiment of a terminal fixture according to the present invention when viewed from the front side and the back side, respectively.
Figure 3B:
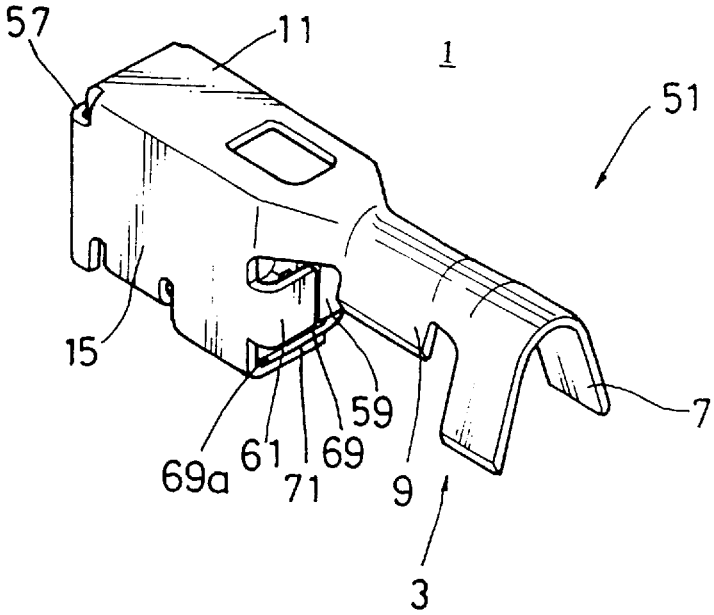
Figure 4:
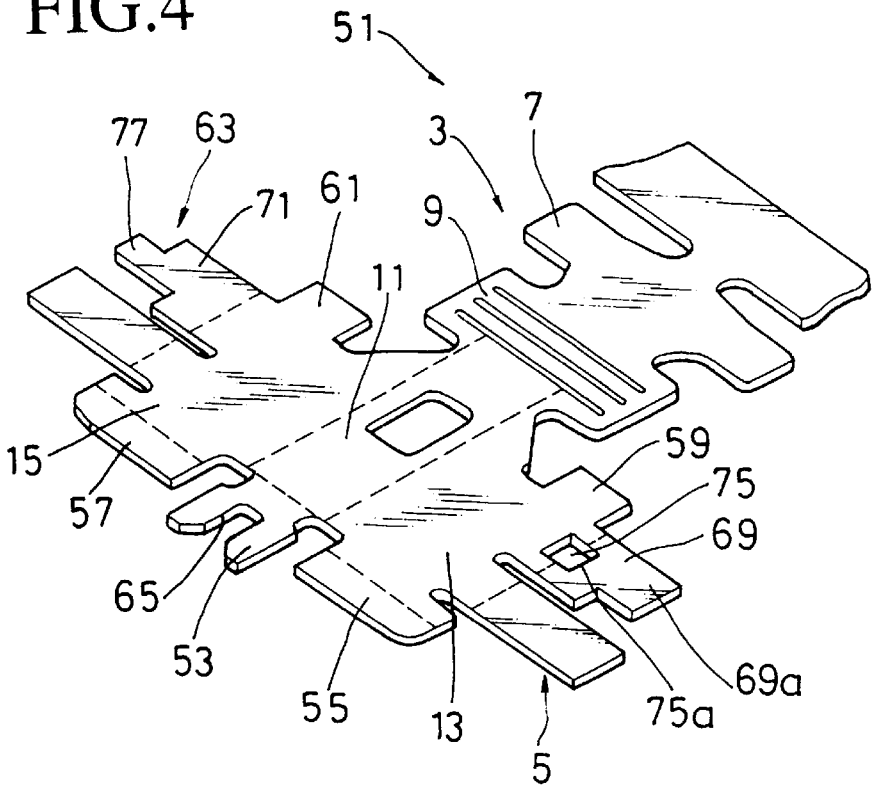
FIG. 4 is a perspective view showing the expanded state of the terminal fixture of the second embodiment according to the present invention.
Figure 5:
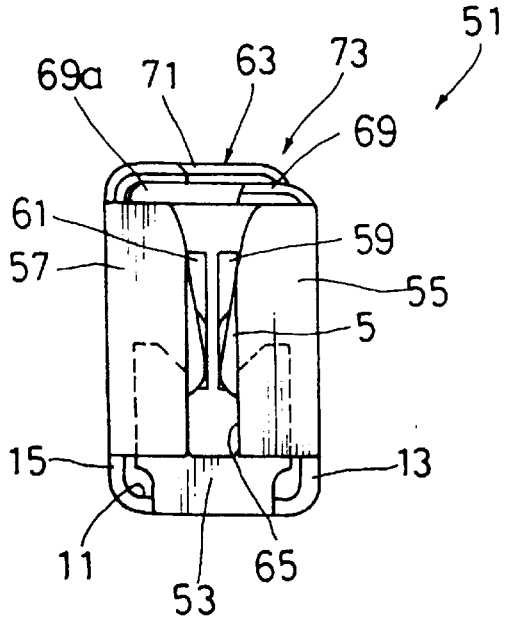
FIG. 5 is a front view of the terminal fixture of the second embodiment according to the present invention.
Figure 6:
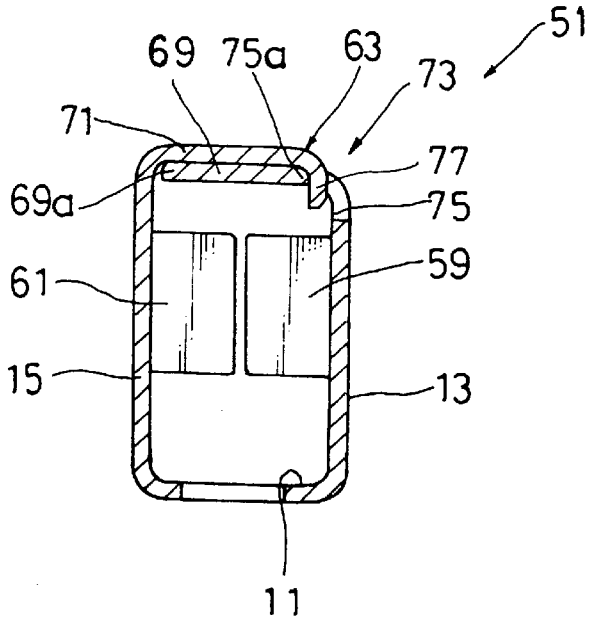
FIG. 6 is a sectional view showing the inside of the terminal fixture of the second embodiment according to the present invention.

FIGS. 3A and 3B are perspective views of a terminal fixture 51 of a second embodiment when viewed from the front side and the back side, respectively. FIG. 4 is a perspective view showing the terminal fixture 51 in a spread state. Also, FIG. 5 is a front view showing the terminal fixture 51; and FIG. 6 is a sectional view showing the terminal fixture 51. The terminal fixture and like components shown in FIG. 1 are designated by the same reference codes to omit a duplicated explanation.

As shown in FIGS. 3A and 3B, the terminal fixture 51 of this embodiment has a side protective plate 53 formed perpendicularly to the pair of the side plates 13, 15 by being bent from the front side of the bottom plate 11, a pair of front protective plates 55, 57 which are formed by being bent from the pair of the side plates 13, 15 and surround the front side of the side protective plate 53, a pair of rear protective plates 59, 61 formed by being bent in a direction in which they approach each other from the electric wire connection member 3 side of the above-mentioned pair of side plates 13, 15, and a top plate 63 which is formed by being extendedly provided from both the above-mentioned pair of side plates 13, 15 between the electric wire connection member 3 and the elastic contact member 5 to overlap and link the extended parts.

Referring to the spread state view shown in FIG. 4, the shape of the terminal fixture 51 will be explained hereinafter. In FIG. 4, dotted line shows a fold (bending line).

The side protective plate 53, as shown in FIG. 3A, is formed by extending of the front end of the bottom plate 11, and the length thereof is set at a value approximately half the height of the elastic contact member 5. The width dimension of the side protective plate 53 is set at a value substantially equal to that of the bottom plate 11. The side protective plate 53 is formed at the middle position with a slit 65 corresponding to a position at which the top ends of the elastic contact member 5 contact each other. The side protective plate 53 is arranged perpendicularly to the pair of side plates 13, 15 by being bent substantially perpendicularly to the bottom plate 11. For this reason, when an external force F3 is applied toward the inside of the pair of side plates 13, 15, the plates abut both the sides of the side protective plate 53. Formed on the front side of the side protective plate 53 are the pair of front protective plates 55, 57.

The pair of front protective plates 55, 57 are extendedly provided from the front side of the side plates 13, 15, and then bent substantially perpendicularly and in a direction in which they approach each other. In this case, the side protective plate 53 is arranged between the pair of front protective plates 55, 57 and the elastic contact member 5. Formed between the top ends of the pair of front protective plates 55, 57 is a gap 67 (see FIG. 3A) corresponding to the slit 65. These front protective plates 55, 57 blocks directly an external force F7 applied from the forward side of the terminal fixture 51 to protect the elastic contact member 5.

On the other hand, the rear side of the pair of side plates 13, 15, as shown in FIG. 3B, is formed with a pair of rectangular rear protective plates 59, 61 formed by being extendedly provided from the pair of side plates 13, 15 and then by being bent substantially perpendicularly and in a direction in which they approach each other. There is somewhat a gap between these rear protective plates 59. When a force F6 in a direction of compression is applied to the pair of side plates 13, 15, the top ends of the pair of rear protective plates 59, 61 abut each other, thereby preventing a deformation of the pair of side plates 13, 15 due to the force F6 in a direction of compression. The top plate 63 is integrally formed at the upper end of the pair of side plates 13, 15 on these rear protective plates 59, 61 side.

The top plate 63 comprises a lower side plate 69 which is formed by being extendedly provided from the one side plate 13 and then bent substantially perpendicularly to the other side plate 15 side, and an upper side plate 71 which is formed by being extendedly provided from the other side plate 15 and then bent substantially perpendicularly to the one side plate 13 side to overlap the lower side plate 69. When an external force F6 in a direction of compression is applied to the pair of side plates 13, 15, a top end 69*a* of the lower side plate 69 abuts the inner wall on the side plate 15 side of the upper side plate 71, thereby preventing the pair of side plates 13, 15 from being deformed. Further, the lower side plate 69 and the upper side plate 71 are linked through a link part 73.

The link part 73, as shown in FIG. 6, comprises a lock hole provided on the one side plate 13 side of the lower side plate 69, and a catch part 77 which is provided at the top end of the upper side plate 71, and inserted into the lock hole 75 and at the same time, caught by an open edge 75*a* of the lock hole 75. The lower side plate 69 and the upper side plate 71 are linked through the link part 73, whereby when an external force F4 in a direction in which the side plates 13, 15 of the elastic contact member 5 are separated from each other is applied, the side plates 13, 15 are not separated by the external force F4 (see FIG. 3A) because the catch part 77 has been engaged with the open edge 75*a* of the lock hole 75.

A method of manufacturing the terminal fixture 51 of the second embodiment will be explained hereinafter.

As shown in FIG. 4, the terminal fixture 51 is molded by punching the fixture in a spread state from a flat plate. In this case, the terminal fixture 51 is a laterally chain type terminal fixture, and a plurality of terminal fixtures are bent continuously from a lengthy flat plate to mold. In FIG. 4, reference code 79 designates a band-shaped member for linking a plurality of terminal fixtures 51. A lengthy flat plate is punched to form the electric wire connection member 3, the elastic contact member 5, the bottom plate 11, the pair of side plates 13, 15, as well as, the side protective plate 53, the pair of front protective plates 55, 57, the pair of rear protective plates 59, 61, the top plate 63, the lock hole 75, the catch part 77, all of which are in a spread state.

Then, the elastic contact member 5 is bent in a reverse U-shape, and the electric wire connection member 3 bent in a U-shape. Also, the pair of front protective plates 55, 57 are bent substantially perpendicularly to and in the same direction as that of the pair of side plates 13, 15. Further, the upper side plate 71 and the lower side plate 69 are bent substantially perpendicularly to and in the same direction as that of the pair of side plates 13, 15. At this point, the catch part 77 is bent substantially perpendicularly to the upper side plate 71.

Following this step, the side protective plate 53 is bent substantially perpendicularly to the bottom plate 11, and at the same time, the side plate 13 and the side plate 15 are bent with respect to the bottom plate 11. At this point, the side plate 13 is first bent substantially perpendicularly and then the side plate 15 is bent, whereby the catch part 77 is inserted into the lock hole 75, and engaged with the open edge 75*a* of the lock hole 75. This causes the lower side plate 69 and the upper side plate 71 to be overlapped to form the top plate 63. Also, the pair of side plates 13, 15 are bent with respect to the bottom plate 11, whereby the pair of front protective plates 55, 57 are arranged on the front side of the side protective plate 53.

According to this embodiment, with respect to the external force F3 of deforming forcibly inward the pair of side plates 13, 15, the side protective plate 53 abuts the inner wall of the pair of side plates 13, 15, thereby enhancing the rigidity in that direction. Accordingly, the pair of side plates 13, 15 are not deformed inward and inadvertently.

With respect to the external force F4 of deforming forcibly the elastic contact member 5 in a direction in which the member is separated, the catch part 77 is engaged with the open edge 75*a* of the lock hole 75, whereby the elastic contact member 5 is not separated.

With respect to the external force F5 from the upper side of the terminal fixture 51, the top plate 63 is provided, whereby the terminal fixture 51 is not entirely deformed by the force in that direction, and the elastic contact member 5 is also not deformed.

Also, with respect to the external force F6 in a direction in which the pair of side plates 13, 15 are compressed, the pair of rear protective plates 59, 61 and the top end 69*a* of the lower side plate 69 abut the inner wall of the upper side plate 71 to enhance the rigidity in that direction, whereby the pair of side plates 13, 15 are not deformed inadvertently.

Further, with respect to the external force F7 from the forward side of the terminal fixture 51, the pair of front protective plates 55, 57 receive the force in that direction, whereby the external force is not directly applied to the elastic contact member 5 to allow a deformation of the elastic contact member 5 to be prevented.

It should be understood that many modifications and adaptations of the invention will become apparent to those skilled in the art and it is intended to encompass such obvious modifications and changes in the scope of the claimed appended hereto.

What is claimed is:

1. A terminal fixture, comprising:

an electric wire connection member connected to the terminal of an electric wire;

a pair of elastic contact members in which respective top ends of a pair of side plates opposite to each other and bent in the same direction from a bottom plate are bent inward in a reverse U-shape; and a protective plate member comprising a front protective plate provided integrally with said bottom plate on a front side of the pair of elastic contact members, a pair of said protective plates which surround the outside of said pair of side plates and is formed by bending both the sides of the front protective plate toward said electric wire connection member side, and a top plate which is located between said electric wire connection member and said pair of elastic contact members and the top end thereof is extendedly provided from the one side protective plate and locked to the other side protective plate.

2. A terminal fixture according to claim 1, wherein:

a cutout being provided at the top end of said top plate; a prong inserted into the cutout being provided on said other side protective plate; and catch parts overlapping the outside of said other side protective plate being bent and formed at the top end of said top plate.

3. A terminal fixture according to claim 1, wherein:

provided between said electric wire connection member and said pair of elastic contact members are a pair of support walls which are bent in the same direction from said bottom plate and urge the under surface of said top plate to support.

4. A terminal fixture according to claim 3, wherein:

a cutout being provided at the top end of said top plate; a prong inserted into the cutout being provided on said other side protective plate; and catch parts overlapping the outside of said other side protective plate being bent and formed at the top end of said top plate.

5. A terminal fixture, comprising:

an electric wire connection member connected to the terminal of an electric wire;

a pair of elastic contact members in which the respective top ends of a pair of side plates opposite to each other and bent in the same direction from a bottom plate are bent inward in a reverse U-shape;

side protective plates which are bent from a front side of said bottom plate and formed perpendicularly to said pair of side plates;

a pair of front protective plates which are bent and formed from a respective front side of said pair of side plates to surround a front side of said side protective plates;

a pair of rear protective plates which are bent and formed in a direction in which they approach each other from said electric wire connection member of said pair of side plates; and top plates which are located between said electric wire connection member and said pair of elastic contact members, and extendedly provided from both sides of said pair of side plates so as to overlap each other and link.

6. A terminal fixture according to claim 5, wherein:

said top plates comprise a lower side plate which is extendedly provided from the one side plate and bent to the other side plate side, and an upper side plate which is extendedly provided from the other side plate and bent to the one side plate side so as to be overlapped on the lower side plate, whereby the lower side plate and the upper side plate being linked through a link part.

7. A terminal fixture according to claim 6, wherein:

said link part comprises a lock hole provided on said one side plate side of said lower side plate, and a catch part which is provided at the top end of said upper side plate so as to be inserted into said lock hole and engaged with the open edge of said lock hole.

8. A method of manufacturing a terminal fixture, comprising the steps of:

punching a flat plate in a spread state to integrally form a bottom plate, an electric wire connection member connected to the terminal of an electric wire, a pair of side plates, a pair of elastic contact members connected to a mating terminal, and a protective plate member comprising a front protective plate provided on the front side of the pair of elastic contact members, a pair of side protective plates surrounding an outside of said pair of side plates, and a top plate which is located between said electric wire connection member and said pair of elastic contact members and provided on an upper side of said pair of elastic contact members;

bending in the same direction parts which are located on both the sides of said bottom plate and correspond to said electric wire connection member to form the member;

bending a pair of top ends of parts which are extendedly provided on both the sides of said bottom plate and correspond to said pair of side plates in the same direction and in a U-shape, and then bending the parts corresponding to said pair of side plates in the same direction to form said pair of side plates and said elastic contact members;

bending parts corresponding to said pair of side protective plates in the same direction with respect to parts corresponding to said front protective plate, and bending parts corresponding to said front protective plate toward said elastic contact members to form said front protective plate and said pair of side protective plates; and bending a part corresponding to said top plate extendedly provided from the one side protective plate, toward the other side protective plate, and locking the top end of the part to said other side protective plate to form said top plate.

9. A method of manufacturing a terminal fixture, comprising the steps of:

punching a flat plate in a spread state to integrally form a bottom plate, an electric wire, a pair of side plates, a pair of elastic contact members connected to a mating terminal, a pair of side protective plates and a pair of front protective plates provided on a front side of the pair of elastic contact members, a rear protective plate provided on said electric wire connection member side of the pair of elastic contact members, and a top plate which is located between said electric wire connection member and said pair of elastic contact members, and provided on the upper side of said pair of elastic contact members and which comprises an upper side plate, a lower side plate and a link part for linking both the plates;

bending in the same direction parts which are located on the both the sides of said bottom plate and correspond to said electric wire connection member to form the member;

bending both the front side and said electric wire connection member side of parts which are extendedly provided on both the sides of said bottom plate and correspond to said pair of side plates in the same direction to form said pair of front protective plates and said pair of rear protective plates;

bending a pair of top ends of parts corresponding to said pair of side plates in the same direction and in a U-shape to form said elastic contact members;

bending the other respective top ends of parts corresponding to said pair of said plates in the same direction to form said upper side plate and said lower side plate;

bending parts extendedly provided on the front side of said bottom plate to form said pair of side protective plates; and bending respective parts corresponding to said pair of side plates in the same direction to form said pair of side plates and at the same time, linking said link part in a state in that said upper side plate is overlapped on said lower side plate to form said top plate.

10. A method of manufacturing a terminal fixture according to claim 9, wherein:

said top plate comprises a lock hole provided on said one side plate side of said lower side plate and a catch part provided at the top end of the said upper side plate; and the catch part being inserted into said lock hole and engaged with the open edge of said lock hole to form said top plate.

* * * * *